US009302860B2

(12) United States Patent
Hirose

(10) Patent No.: US 9,302,860 B2
(45) Date of Patent: Apr. 5, 2016

(54) IMAGE FORMING APPARATUS

(71) Applicant: Brother Kogyo Kabushiki Kaisha, Nagoya-shi, Aichi-ken (JP)

(72) Inventor: Atsuo Hirose, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/466,151

(22) Filed: Aug. 22, 2014

(65) Prior Publication Data

US 2015/0054217 A1 Feb. 26, 2015

(30) Foreign Application Priority Data

Aug. 23, 2013 (JP) ..... 2013-173461

(51) Int. Cl.
*B65H 7/02* (2006.01)
*B65H 1/04* (2006.01)

(52) U.S. Cl.
CPC ..... *B65H 1/04* (2013.01); *B65H 2511/10* (2013.01); *B65H 2511/20* (2013.01); *B65H 2553/612* (2013.01); *B65H 2701/1131* (2013.01)

(58) Field of Classification Search
CPC ..... B65H 11/02; B65H 2403/5332; B65H 2701/113; B65H 2701/1131
See application file for complete search history.

(56) References Cited

U.S. PATENT DOCUMENTS

| | | | | |
|---|---|---|---|---|
| 5,655,764 | A | 8/1997 | Ota et al. | |
| 7,441,769 | B2 | 10/2008 | Miki | |
| 7,516,955 | B2 | 4/2009 | Yamagishi | |
| 7,694,960 | B2 * | 4/2010 | Sing | 271/171 |
| 8,584,371 | B2 | 11/2013 | Marumoto et al. | |
| 2006/0087073 | A1 | 4/2006 | Yamagishi | |
| 2006/0180981 | A1 | 8/2006 | Miki | |
| 2012/0117814 | A1 | 5/2012 | Marumoto et al. | |

FOREIGN PATENT DOCUMENTS

| | | | |
|---|---|---|---|
| JP | H08-34525 | A | 2/1996 |
| JP | H08-119462 | A | 5/1996 |
| JP | H11-139572 | A | 5/1999 |
| JP | 2001-180828 | A | 7/2001 |
| JP | 2004-106982 | A | 4/2004 |
| JP | 2005-179069 | A | 7/2005 |
| JP | 2006-117377 | A | 5/2006 |
| JP | 2006-137597 | A | 6/2006 |
| JP | 2006-188357 | A | 7/2006 |
| JP | 2006-341973 | A | 12/2006 |
| JP | 2008-280105 | A | 11/2008 |
| JP | 2012-116658 | A | 6/2012 |

* cited by examiner

*Primary Examiner* — Howard Sanders
(74) *Attorney, Agent, or Firm* — Banner & Witcoff, Ltd.

(57) ABSTRACT

An image forming apparatus includes a sheet supply tray having a plate for supporting a sheet to be supplied to an image forming unit, a first sheet positioning member configured to move relative to the plate and position the sheet, a moving member including a first detection portion and configured to move in a sheet supply direction in response to movement of the first sheet positioning member, a coupling member coupling the first sheet positioning member and the moving member and configured to move the moving member in response to the movement of the first sheet positioning member in the sheet supply direction, and a restriction mechanism configured to restrict movement of the coupling member according to an amount of the movement of the first sheet positioning member.

18 Claims, 9 Drawing Sheets

A4

A5

A6
17F
41B (41)
17E
31
29
23
L3
21A
33
27
19D
19
41B(41)
41A(41)
19A
L1
L2
R
F
L

IMAGE FORMING APPARATUS

CROSS REFERENCE TO RELATED APPLICATION

This application claims priority from Japanese Patent Application No. 2013-173461, filed on Aug. 23, 2013 which is incorporated herein by reference in its entirety.

TECHNICAL FIELD

Aspects of the disclosure relate to an image forming apparatus configured to form an image on a sheet.

BACKGROUND

A known image forming apparatus includes a sheet supply tray configured to receive a stack of sheets, which are to be fed to an image formation unit. The sheet supply tray is provided with a sheet positioning member to position the sheets not to move in the sheet supply tray. The sheet positioning member is movable relative to a bottom plate of the sheet supply tray to cope with various sized sheets.

The image forming apparatus includes a plurality of switches and a detection plate configured to move in response to the position of the sheet positioning member. The sheet supply tray is configured to determine (or detect) the position of the sheet positioning member, that is, the size of a sheet by changing the on-off states of the switches by the detection plate.

SUMMARY

In the image forming apparatus, the detection plate is configured to move in response to the position of the sheet positioning member. Thus, as an area in which the sheet positioning member moves expands, an area in which the detection plate moves also expands on a proportional basis. If the number of sizes of sheets of which the sheet supply tray can receive increases, the area in which the regulation guide moves expands accordingly.

In other words, if the number of sizes of sheets of which the sheet supply tray can receive increases, an area in which the detection plate moves expands accordingly, and a problem such as a collision of the detection plate with other components may arise. Thus, it is difficult to maintain the area in which the detection plate moves.

Illustrative aspects of the disclosure provide an image forming apparatus configured to prevent an area in which a moving member, such as a detection plate and a slider, moves from expanding in response to an increase in the number of sizes of sheets a sheet supply tray can receive.

According to an aspect of the disclosure, an image forming apparatus includes an image forming unit configured to form an image on a sheet, a sheet supply tray having a bottom plate for supporting the sheet to be supplied to the image forming unit, a first sheet positioning member configured to move relative to the bottom plate in a sheet supply direction and to position the sheet supported on the bottom plate by contacting an upstream end portion of the sheet in the sheet supply direction, a moving member including a first detection portion and configured to move in the sheet supply direction in response to movement of the first sheet positioning member in the sheet supply direction, a detection unit configured to detect the first detection portion of the moving member to determine a position of the first sheet positioning member, a coupling member pivotally coupled at one end portion to the moving member and pivotally coupled at the other end portion to the first sheet positioning member and configured to move the moving member in response to the movement of the first sheet positioning member in the sheet supply direction, and a restriction mechanism configured to restrict movement of the coupling member. The restriction mechanism is configured to restrict the movement of the coupling member such that, when an amount of the movement of the first sheet positioning member in the sheet supply direction is smaller than or equal to a specified amount, a central portion of the coupling member in a longitudinal direction thereof moves in the sheet supply direction together with the first sheet positioning member. The restriction mechanism is configured to restrict the movement of the coupling member such that, when the amount of the movement of the first sheet positioning member in the sheet supply direction exceeds the specified amount, the central portion of the coupling member is prevented from moving further in the sheet supply direction together with the first sheet positioning member and the coupling member pivotally moves about the central portion thereof.

With this structure, when the amount of the movement of the first sheet positioning member in the sheet supply direction is smaller than or equal to a specified amount, the moving member moves together with the first sheet positioning member in a same direction as that of the first sheet positioning member. When the amount of the movement of the first sheet positioning member in the sheet supply direction exceeds the specified amount, the moving member moves in an opposite direction that of the first sheet positioning member.

In other words, even when an area in which the first sheet positioning member moves expands, the need to expand an area in which the moving member moves on a proportional basis can be obviated. Thus, even if the number of sizes of sheets the sheet supply tray can receive increases, the need to expand the area in which the moving member, such as a detection plate and a slider, moves can be reduced.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings.

The following discussion will be made as to an electrophotographic image forming apparatus to which the present disclosure is applied. Arrows indicating directions in each drawing are indicated to facilitate the understanding of positional relationships among components. For portions or components, which will be described with numerals, at least one is provided unless "plural" or "two or more" is specifically stated otherwise.

A general structure of an image forming apparatus 1 will be described in detail.

Figure 1:
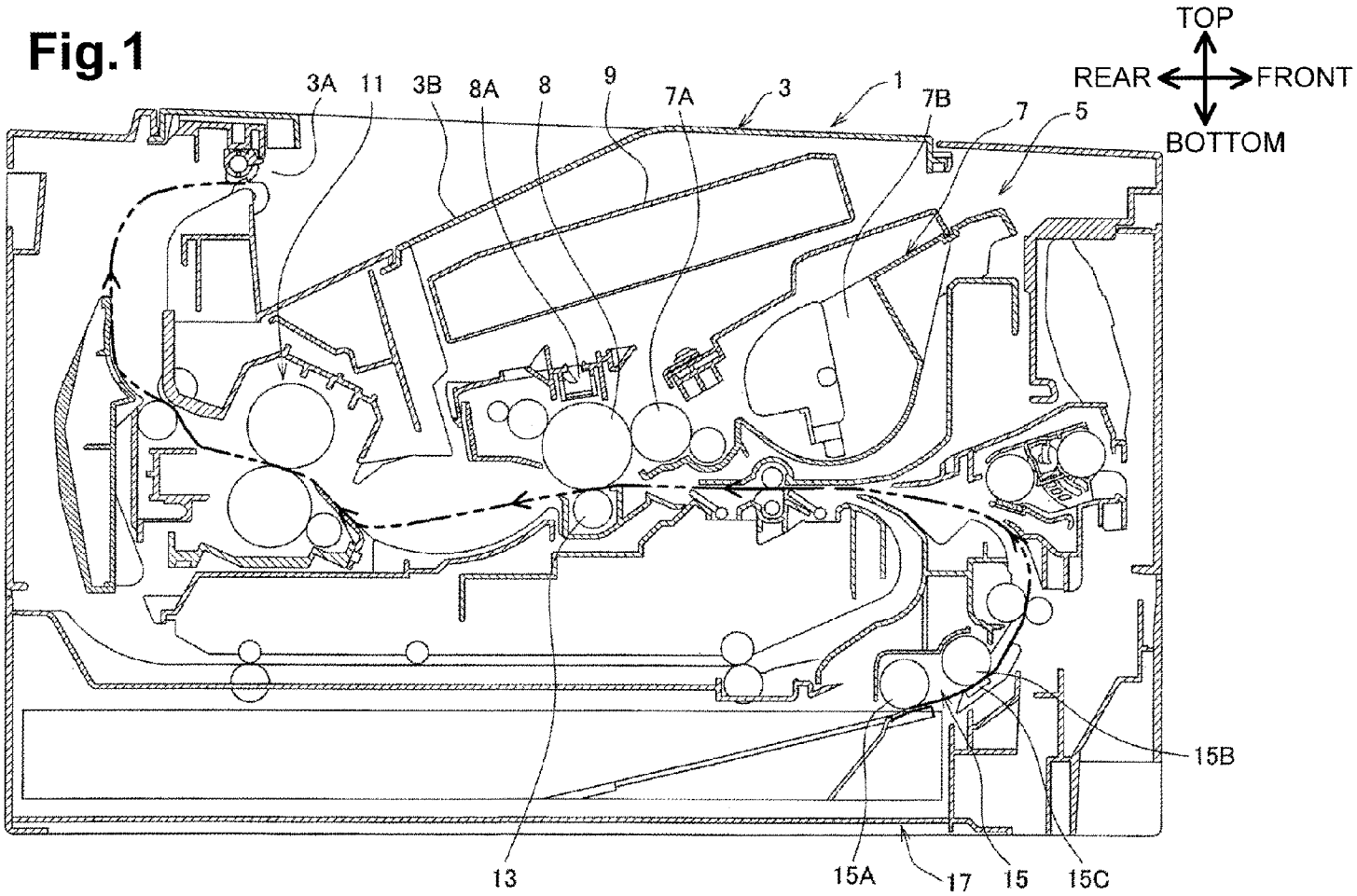
FIG. 1 is a sectional view of an illustrative image forming apparatus according to an embodiment of the disclosure.

As shown in FIG. 1, the image forming apparatus 1 includes a casing 3, and an image forming unit 5 configured to form an image on a sheet. The image forming unit 5 is of an electrophotographic type and includes a developing cartridge 7, a photosensitive drum 8, an exposure unit 9, and a fixing unit 11.

An upper portion of the casing 3 includes an ejection outlet 3A from which a sheet having an image formed thereon is ejected and an ejection tray 3B configured to receive the sheet ejected from the ejection outlet 3A.

The developing cartridge 7 includes a developing roller 7A and a supply roller 7B. The photosensitive drum 8 is configured to carry a developer image thereon. A charger 8A is configured to charge the photosensitive drum 8. The exposure unit 9 is configured to expose the charged photosensitive drum 8. Thereby, an electrostatic latent image is formed on the photosensitive drum 8.

The developing roller 7A is configured to supply developer stored in a storing portion 7B to the photosensitive drum 8 such that a developer image is formed on the photosensitive drum 8. A transfer unit 13 is disposed facing the photosensitive drum 8.

The transfer unit 13 is configured to transfer the developer image carried on the photosensitive drum 8 to a sheet. The transfer unit 13 is subjected to electric charges opposite in polarity to those of the developer image. The developer image is transferred to a sheet by electrostatic attraction force generating between the developer and the transfer unit 13.

The fixing unit 11 is configured to heat the developer image transferred onto the sheet directly or indirectly and fix the developer image to the sheet. A feeder mechanism 15 is disposed upstream of the image forming unit 5 including the transfer unit 13 in a sheet feed direction.

The feeder mechanism 15 is configured to feed a sheet from the sheet supply tray 17 toward the image forming unit 5. The feeder mechanism 15 includes a pickup roller 15A, a separation roller 15B and a separation pad 15C.

The pickup roller 15A is configured to feed at least one of sheets received in the sheet supply tray 17 toward the separation roller 15B. The separation roller 15B is configured to rotate in contact with the sheet fed by the pickup roller 15A and feed the sheet toward the transfer unit 13.

The separation pad 15C is configured to contact the sheet at a position where it faces the separation roller 15B and to apply resistance by friction to the sheet. With this structure, when a few sheets are fed to between the separation pad 15C and the separation roller 15B, a sheet contacting the separation pad 15C is stopped due to the friction and a sheet contacting only the separation roller 15B is conveyed toward the image forming unit 5.

The sheet supply tray 17 is disposed below the image forming unit 5 in the main body and is detachably attached to the main body. The main body refers to portions of the image forming apparatus 1, such as the casing 3 and frames (not shown), which cannot be disassembled by a user.

A general structure of the sheet supply tray 17 will be described.

Figure 2:
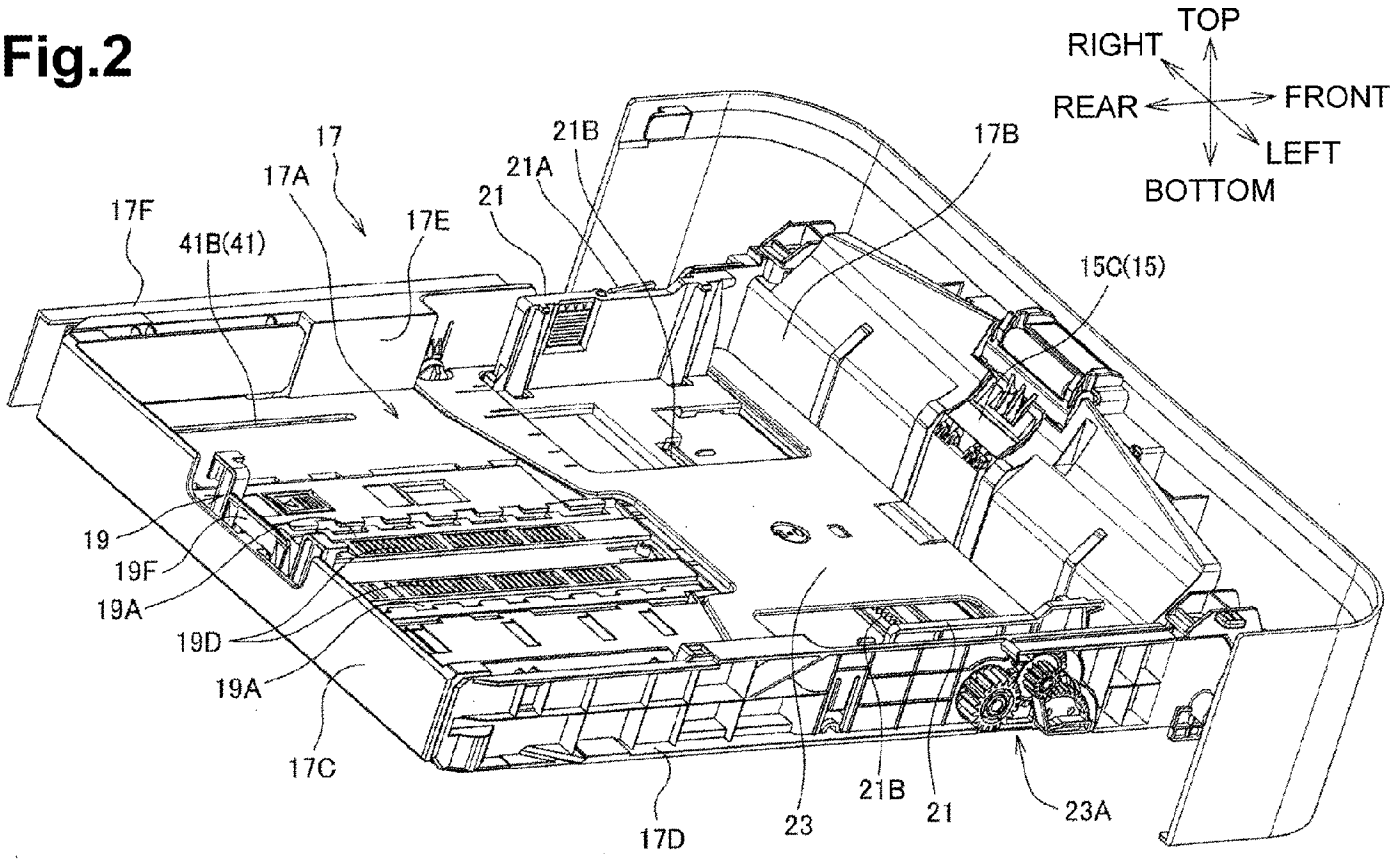
FIG. 2 is a perspective view of a sheet supply tray to be attached to the image forming apparatus.

The sheet supply tray 17 is configured to receive sheets to be supplied to the image forming unit 5. As shown in FIG. 2, the sheet supply tray 17 is a rectangular-shaped tray having a sheet supporting portion, e.g., a bottom plate 17A, and wall portions 17B, 17C, 17D, 17E. The bottom plate 17A forms a bottom of the sheet supply tray 17. The wall portions 17B to 17E stand from end portions of the bottom plate 17A.

A first sheet positioning member 19 and a pair of second sheet positioning members 21 are disposed at the bottom plate 17A. The first sheet positioning member 19 is configured to position a sheet received in the sheet supply tray 17 by contacting an upstream end of the sheet in a sheet supply direction. The second sheet positioning members 21 are configured to position the sheet by contacting ends of the sheet in a width direction.

The sheet supply direction is a direction where a sheet fed by the pickup roller 15A is fed. The width direction is a horizontal direction perpendicular to the sheet supply direction. In the embodiment, a direction parallel to the sheet supply direction agrees with a front-rear direction and the upstream end of a sheet in the sheet supply direction agrees with a rear end of a sheet received in the sheet supply tray 17.

The first sheet positioning member 19 is movable in the direction parallel to the sheet supply direction relative to the bottom plate 17A. The bottom plate 17A includes guide portions 19A and holding portions 19D. The guide portions 19A extend from a rear end of the bottom plate 17A toward a pressing plate 23 along the sheet supply direction and are configured to guide the first sheet positioning member 19.

The holding portions 19D are configured to regulate the movement of the first sheet positioning member 19 and hold the position of the first sheet positioning member 19. Each of the holding portions 19D of the embodiment is made up of a plurality of grooves arranged in a row in the sheet supply direction.

Figure 6:
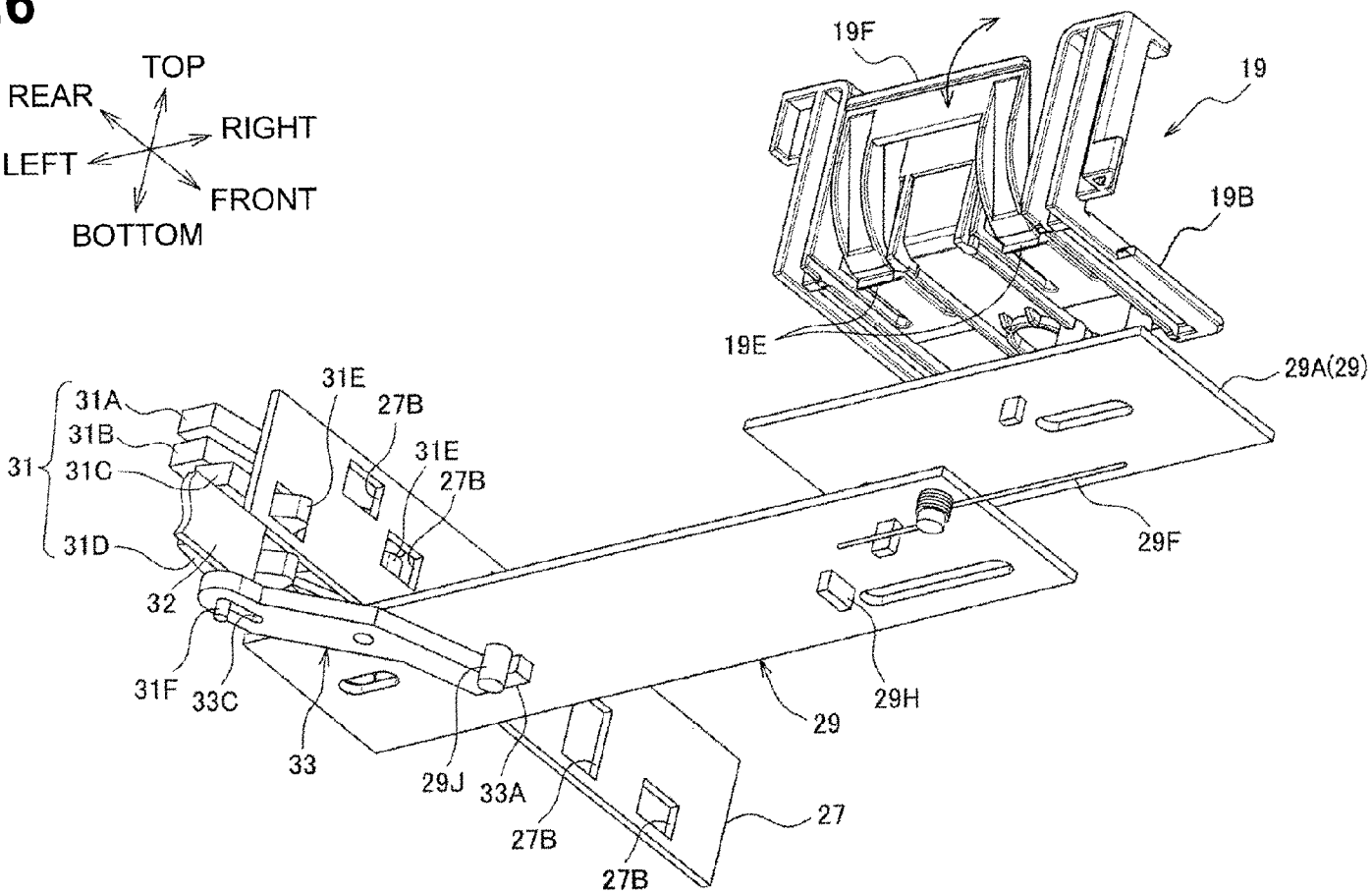
FIG. 6 is an exploded perspective view of the actuator mechanism.

As shown in FIG. 6, the first sheet positioning member 19 includes protrusions 19E. The position of the first sheet positioning member 19 is maintained when the protrusions 19E get caught in the holding portions 19D.

The first sheet positioning member 19 includes a pull 19F operated by a user. When the pull 19F moves in one of the arrowed directions, the protrusions 19E moves in response to movement of the pull 19F between a position where the protrusions 19E get caught in the holding portions 19D and a position where the protrusions 19E are separated from the holding portions 19D.

At least one of the second sheet positioning members 21 is movable in the width direction relative to the bottom plate 17A. The second sheet positioning members 21 move mechanically in response to each other such that they move symmetrically with respect to a center in the width direction.

Specifically, as shown in FIG. 2, each second sheet positioning member 21 includes a rack 21B extending in the width direction. The bottom plate 17A includes pinions (not shown) to engage with the racks 21B. With this structure, the second sheet positioning members 21 move in the width direction in response to each other.

At least one (right one in the embodiment) of the second sheet positioning members 21 includes a grip portion 21A, which is gripped by a user when the user moves the second sheet positioning members 21.

A pressing plate 23 is disposed at the bottom plate 17A. The pressing plate 23 is movable relative to the bottom plate 17A and is configured to move sheets disposed on the pressing plate 23 toward the pickup roller 15A (or upward in the embodiment). Other one (the left one in the embodiment) of the second sheet positioning members 21 includes a moving mechanism 23A configured to move the pressing plate 23.

The moving mechanism 23A is configured to move the pressing plate 23 upward in response to a decrease in the number of sheets received in the sheet supply tray 17. The moving mechanism 23A operates by receiving power from an electric motor (not shown) disposed at the main body.

Operations of the image forming unit 5 and the moving mechanism 23A are controlled by a controller (not shown) disposed at the main body. The controller is configured to detect a size of a sheet to be supplied to the image forming unit 5 by determining the position of the first sheet positioning member 19 and to control the operation of the image forming unit 5 according to the size of the sheet the controller detects.

Figure 3A:
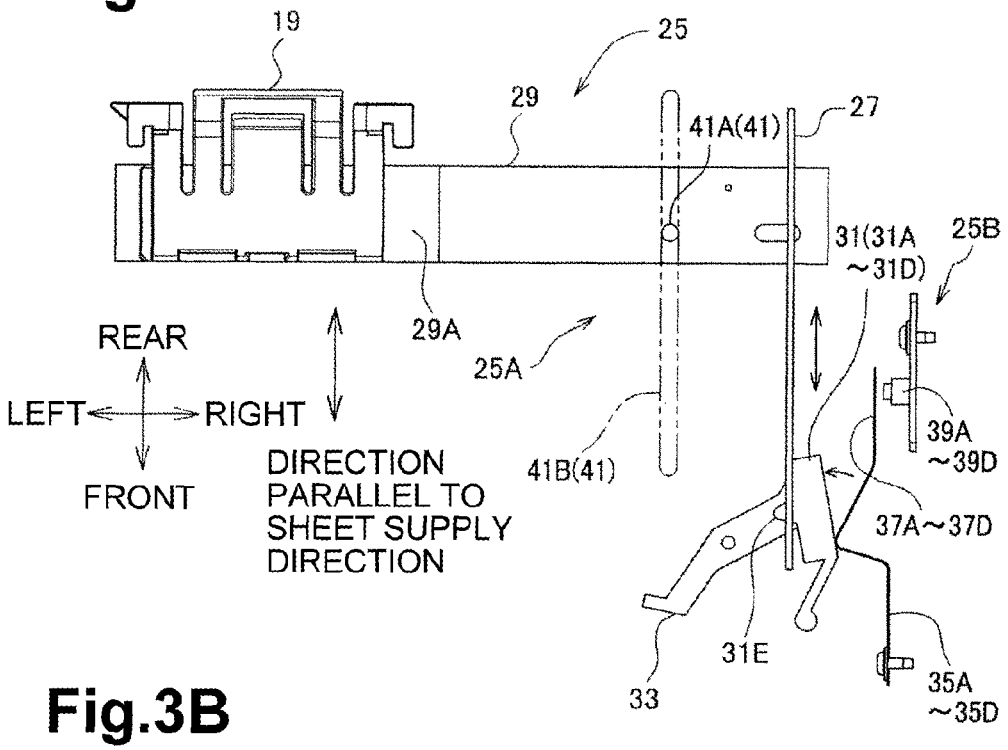
FIGS. 3A and 3B illustrate operational relationship among a first sheet positioning member, a coupling member, a moving member, and movable members.

As shown in FIG. 3A, a mechanism 25 for determining the position of the first sheet positioning member 19 includes an actuator mechanism 25A, an output unit 25B and the controller. The actuator mechanism 25A is a mechanism that operates mechanically in response to the movement of the first sheet positioning member 19.

The output unit 25B is configured to output an electrical signal responsive to the operation state of the actuator mechanism 25A to the controller. The controller is configured to determine the position of the first sheet positioning member 19 through the use of the signal from the output unit 25B. The actuator mechanism 25A is disposed in the sheet supply tray 17. The output unit 25B is disposed at the main body.

The actuator mechanism 25A has, at least, a moving member 27, a coupling member 29, a detection unit 31, and a restriction mechanism 41. The moving member 27 is disposed outside the wall portion 17E such that the moving member 27 is movable in the direction parallel to the sheet supply direction.

The coupling member 29 is configured to move the moving member 27 in the sheet supply direction in response to the movement of the first sheet positioning member 19. The detection unit 31 is configured to control an electric signal outputted from the output unit 25B cooperating with the moving member 27, that is, mechanically control the signal for determining the position of the first sheet positioning member 19.

Figure 4:
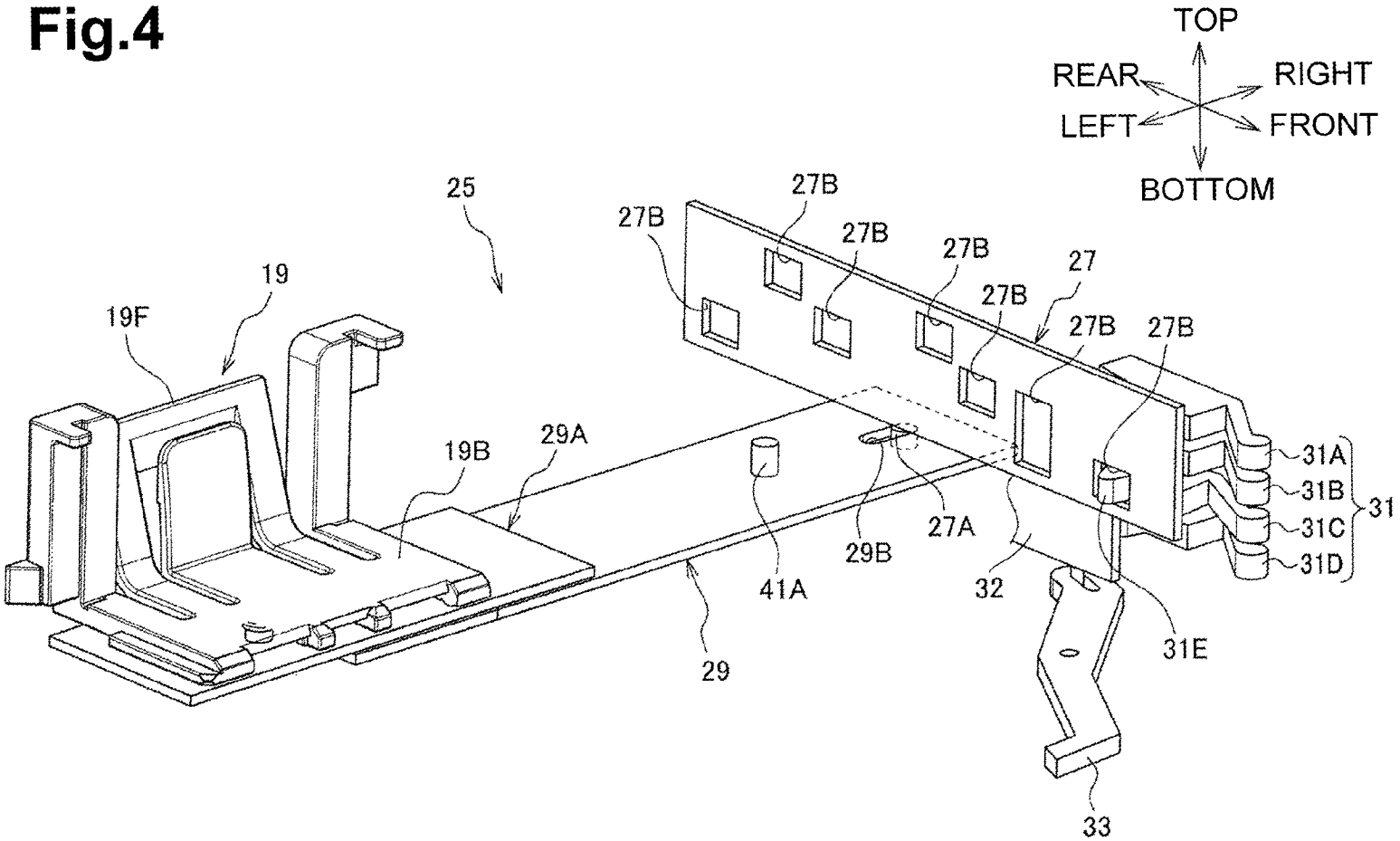
FIG. 4 is a perspective view of the first sheet positioning member, the coupling member, the moving member, and movable members.
Figure 5:
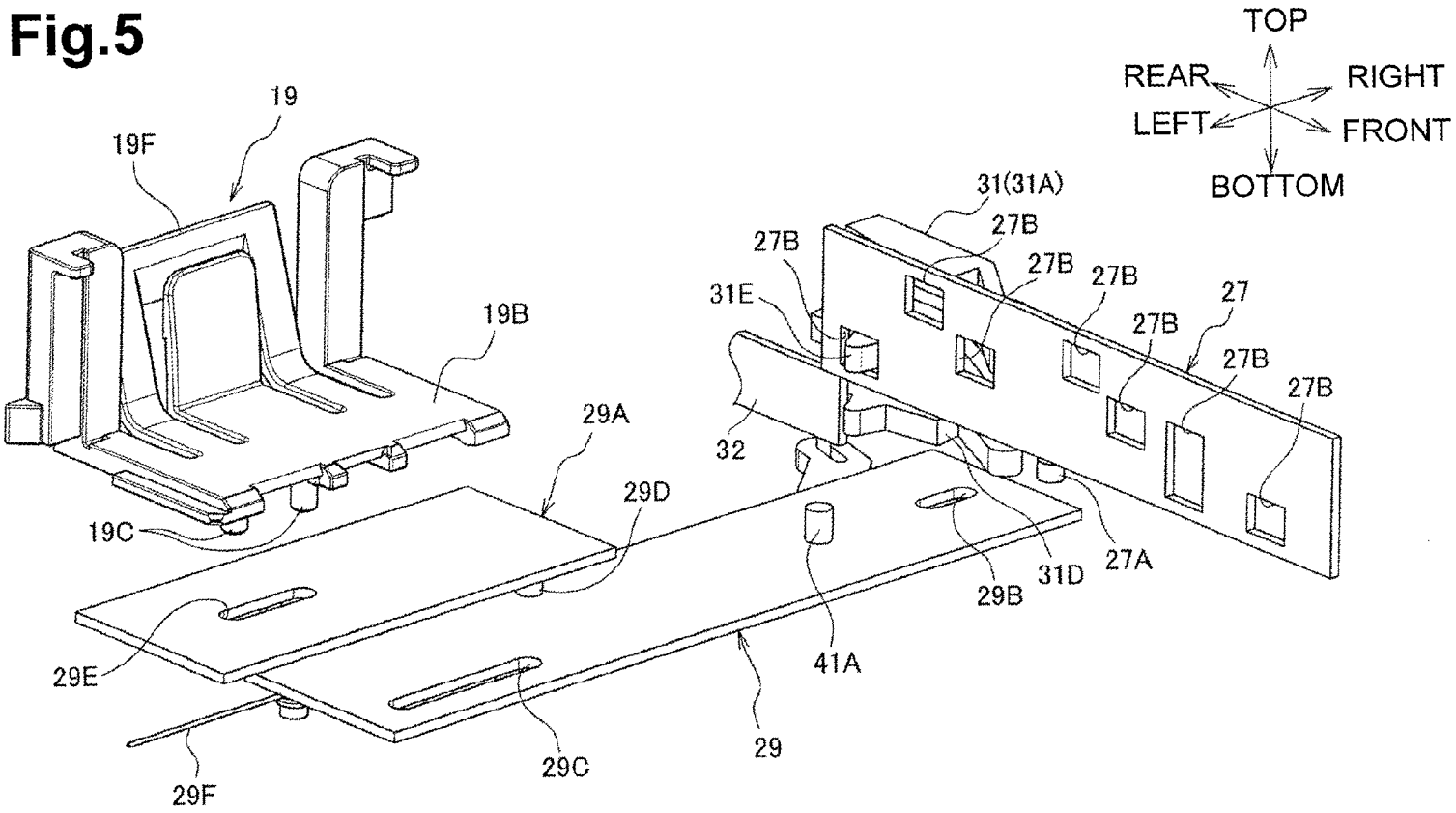
FIG. 5 is an exploded perspective view of an actuator mechanism.

As shown in FIG. 4, the coupling member 29 is coupled at one end portion to the moving member 27 and is coupled at the other end portion to the first sheet positioning member 19 via a coupling plate 29A. In this embodiment, the coupling member 29 is pivotally coupled at one end portion to the moving member 27 and is pivotally coupled at the other end portion to the first sheet positioning member 19. As shown in FIG. 5, the coupling member 29 is a strip and has a first long hole 29B at one end portion thereof in a longitudinal direction and a second long hole 29C at the other end portion thereof.

The first long hole 29B disposed closer to the moving member 27 and the second long hole 29C disposed closer to the coupling plate 29A extend along the longitudinal direction of the coupling member 29. The first long hole 29B is for receiving a first boss 27A of the moving member 27.

The second long hole 29C is for receiving a second boss 29D of the coupling plate 29A. The first boss 27A is configured to slidingly contact an inner surface defining the first long hole 29B. The second boss 29D is configured to slidingly contact an inner surface defining the second long hole 29C.

With this structure, the coupling member 29 is configured to pivotally move relative to the coupling plate 29A and the moving member 27 while moving in the longitudinal direction. The coupling plate 29A is immovably assembled to the base portion 19B of the first sheet positioning member 19.

The base portion 19B has a pair of third bosses 19C protruding toward the coupling plate 29A. The coupling plate 29A has a third long hole 29E for receiving the pair of third bosses 19C therein. With this structure, the coupling plate 29A is combined with the base portion 19B.

Thus, in the embodiment, the first sheet positioning member 19 and the coupling plate 29A are collectively referred to as the first sheet positioning member 19. The first boss 27A, the second boss 29D and the third bosses 19C are cylindrical in shape.

A spring 29F shown in FIG. 6 provides an elastic force for preventing the coupling member 29 from pivotally moving relative to the first sheet positioning member 19. Specifically, the spring 29F gives the coupling member 29 an elastic force to cause a portion of the coupling member 29 closer to the moving member 27 to move toward a downstream side in the sheet supply direction (or frontward of the sheet supply tray 17) with respect to the first sheet positioning member 19.

Figure 7A:
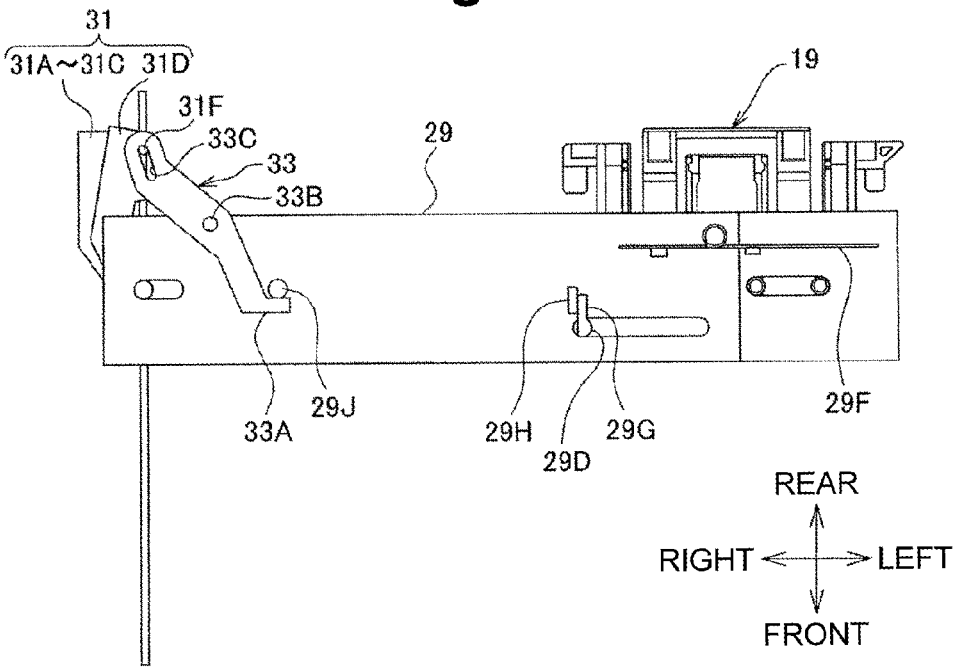
FIG. 7A illustrates that the coupling member is located in a reference position.

With this elastic force, the portion of the coupling member 29 closer to the moving member 27 is prevented from moving toward an upstream side in the sheet supply direction (or rearward of the sheet supply tray 17) with respect to the first sheet positioning member 19. As shown in FIG. 7A, the first sheet positioning member 19 (or the coupling plate 29A in the embodiment) includes a stopper portion 29G acting against the elastic force of the spring 29F.

The stopper portion 29G is configured to apply a force acting against the elastic force to the coupling member 29 by contacting a contact portion 29H of the coupling member 29. When the stopper portion 29G and the contact portion 29H contact each other, the portion of the coupling member 29 closer to the moving member 27 is prevented from moving further toward the downstream side in the sheet supply direction.

In other words, the spring 29F applies an elastic force for maintaining the coupling member 29 at a position where the stopper portion 29G and the contact portion 29H contact each other (hereinafter referred to a reference position) to the coupling member 29. In the embodiment, when the coupling member 29 is in the reference position, the longitudinal direction of the coupling member 29 agrees with the width direction.

Figure 7B:
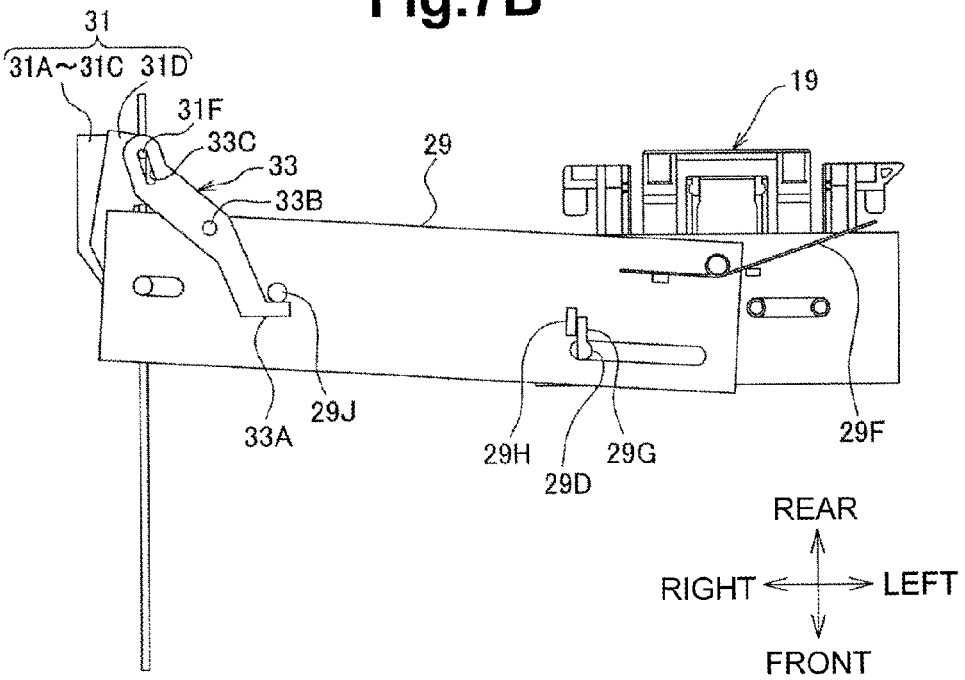
FIG. 7B illustrates that the coupling member moves from the reference position.

As shown in FIG. 7B, when the coupling member 29 moves from the reference position, a contact angle between the stopper portion 29G and the contact portion 29H changes. In the embodiment, when the coupling member 29 moves from the reference position, the longitudinal direction of the coupling member 29 is inclined relative to the width direction.

Figures 8A, 8B, 8C:
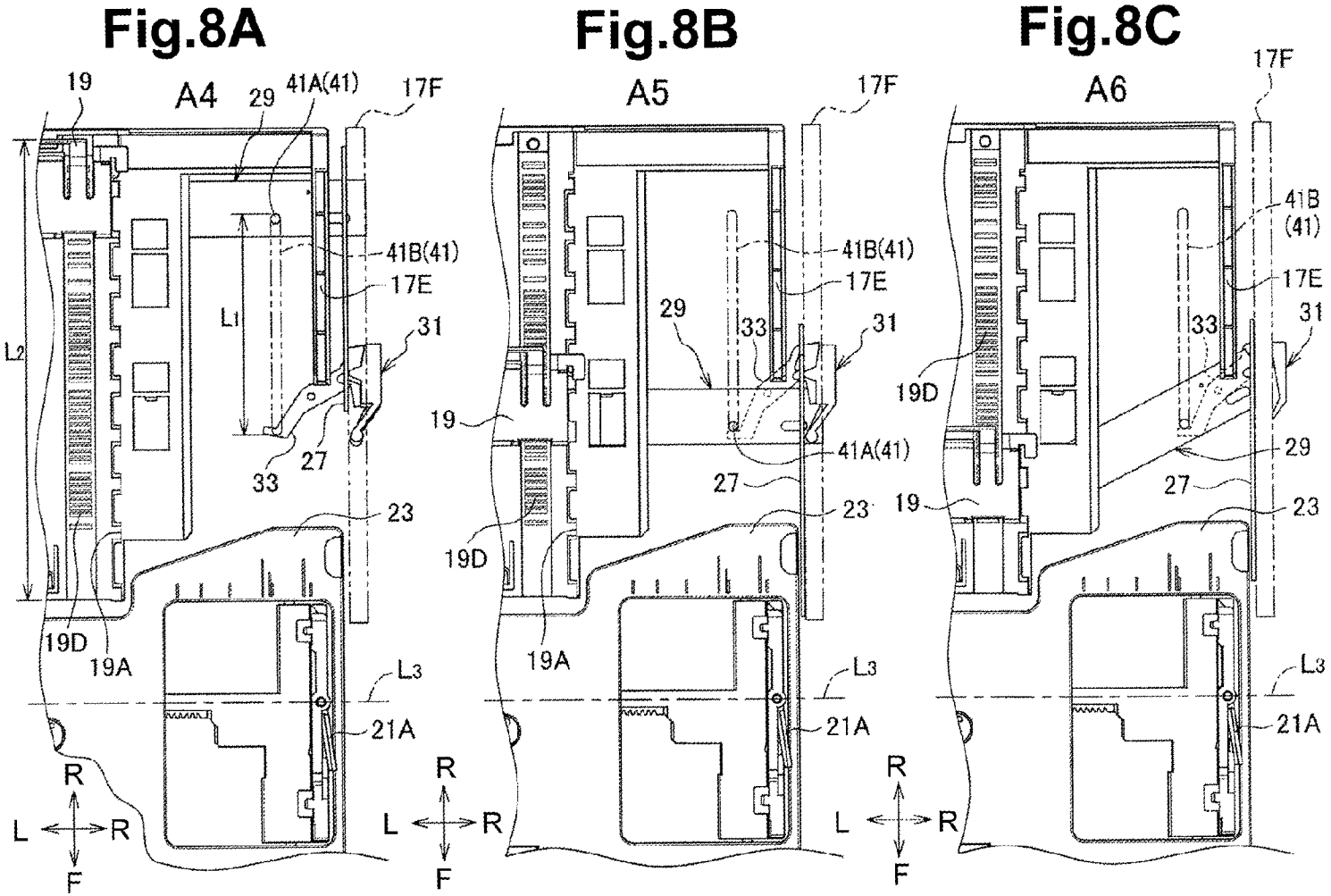
FIG. 8A illustrates a state of the first sheet positioning member, the coupling member, and the moving member when an A4-sized sheet is placed.
FIG. 8B illustrates a state of the first sheet positioning member, the coupling member, and the moving member when an A5-sized sheet is placed.
FIG. 8C illustrates a state of the first sheet positioning member, the coupling member, and the moving member when an A6-sized sheet is placed.

As shown in FIG. 8A, the movable member 27 is a strip having a plate surface parallel to the wall portion 17E. The movable member 27 is disposed outside of the wall portion 17E. The wall portion 17E is disposed on the opposite side of the bottom plate 17A in the horizontal direction to the moving mechanism 23A, that is, on the right side of the sheet supply tray 17.

Figure 9:
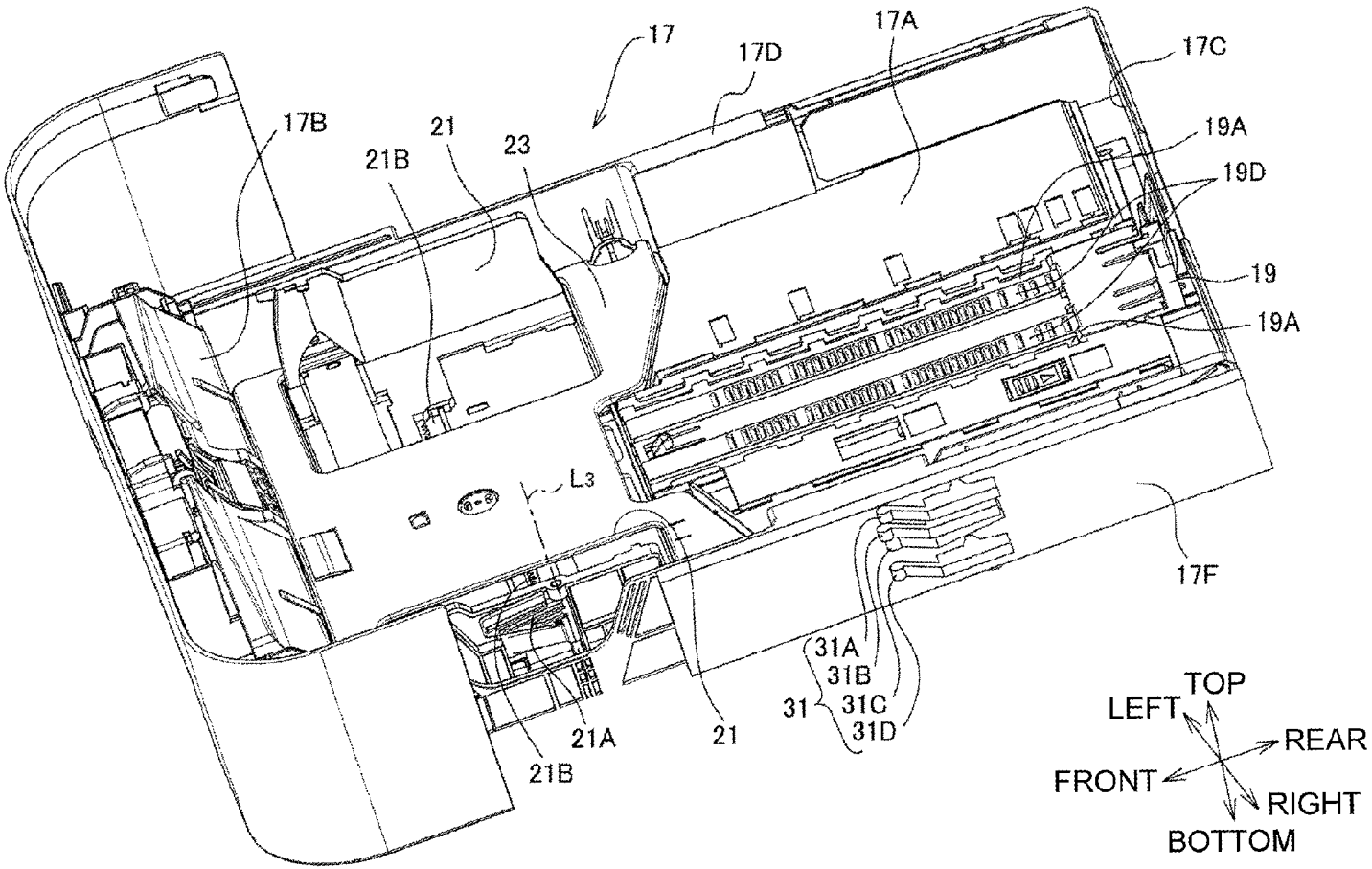
FIG. 9 is a perspective view of the sheet supply tray.

An outer side of the movable member 27, that is, an opposite side of the movable member 27 to the wall portion 17E, is covered by a cover 17F as shown in FIG. 9. The cover 17F is assembled to the wall portion 17E.

As shown in FIG. 4, the moving member 27 includes a plurality of first detection portions 27B. The first detection portions 27B may be holes recessed in or passing through the moving member 27 in its thickness direction. The first detection portions 27B are also referred to as detection holes 27B.

The detection unit 31 has movable members 31A to 31D movably assembled to the cover 17F. The movable members 31A to 31C have respective sliding contact portions 31E. The sliding contact portions 31E protrude toward the moving member 27 and are configured to slidingly contact the moving member 27.

Figure 3B:
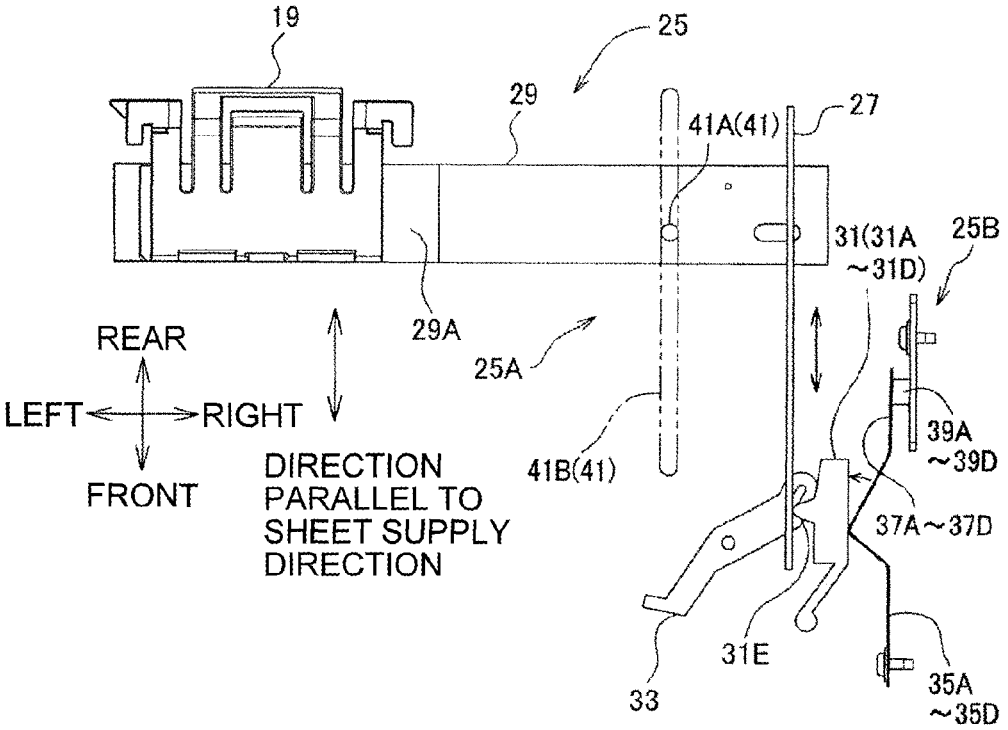

Each of the movable members 31A to 31C is configured to pivotally move between a position where the sliding contact portion 31E is inserted into the detection hole 27B (FIG. 3A) and a position where the sliding contact portion 31E contacts the plate surface of the moving member 27 (FIG. 3B). Hereinafter, the movable members 31A to 31C are referred to as first movable members 31A to 31C.

A pivot point around which each of the first movable members 31A to 31C pivots is fixed. Thus, when the moving member 27 moves in the sheet supply direction, the positions of the detection holes 27B also move in the sheet supply direction and the first movable members 31A to 31C pivot responsively.

As shown in FIG. 4, the movable member 31D (hereinafter referred to as a second movable member 31D) is configured to pivotally move in response to the movement of a detection lever 33 constituting a second detection portion mechanically. The detection lever 33 is configured to move when the amount of movement of the first sheet positioning member 19 exceeds a specified amount.

As shown in FIG. 7A, a central portion of the detection lever 33 in its longitudinal direction is pivotally assembled to the bottom plate 17A. The detection lever 33 includes an engagement portion 33A at one end in the longitudinal direction thereof. The engagement portion 33A is a hook-shaped portion engageable with a fourth boss 29J of the coupling member 29.

The detection lever 33 is pivotally coupled at the other end thereof in the longitudinal direction to the second movable member 31D. Specifically, the detection lever 33 has a long hole 33C near the other end thereof in the longitudinal direction. A plate 32 is disposed outside the wall portion 17E such that the plate 32 is movable in the direction parallel to the sheet supply direction. As shown in FIG. 6, the plate 32 includes a boss 31F engaged in the long hole 33C. The boss 31F is configured to slide in the long hole 33C.

With this structure, when the detection lever 33 pivotally moves, the plate 32 moves in a direction in which the plate 32 uncovers the second movable member 31D in response to the pivotal movement of the detection lever 33, and the second movable member 31D pivotally moves. In other words, when the coupling member 29 moves together with the first sheet positioning member 19 toward the downstream side in the sheet supply direction and the fourth boss 29J contacts and engages with the engagement portion 33A, the detection lever 33 pivotally moves such that one end thereof moves toward the downstream side in the sheet supply direction and the second movable member 31D also pivotally moves concurrently with the detection lever 33.

The amount of movement of the first sheet positioning member 19 is a distance in which the first sheet positioning member 19 moves from a reference position (a position of the first sheet positioning member 19 disposed on the upstream side in the sheet supply direction, shown in FIG. 8A) toward the downstream side in the sheet supply direction. The specified amount is an amount of which the first sheet positioning member 19 moves from the reference position, which is previously set at designing stage.

Springs 35A-35D shown in FIG. 3A are configured to generate elastic force to press the movable members 31A-31D toward the moving member 27. The spring 35A is configured to press the first movable member 31A. The spring 35B is configured to press the first movable member 31B. The spring 35C is configured to press the first movable member 31C.

Thus, when the sliding contact portion 31E is aligned with the detection hole 27B, the first movable member 31A-31C corresponding to the sliding contact portion 31E is pressed by the spring 35A-35C and pivotally moves such that the sliding contact portion 31E slides into the detection hole 27B.

For example, FIG. 4 shows that the sliding contact portion 31E of the first movable member 31C is in the frontmost detection hole 27B and the sliding contact portion 31E of the second movable member 31D is covered by the plate 32. At this time, the first movable member 31C is in the off state, and the first movable members 31A, 31B and the second movable member 31D are in the on state. With this combination, the image forming apparatus 1 recognize A4 size. At this time, the first sheet positioning member 19 is disposed in the position shown in FIG. 8A to position A4-sized sheets.

FIG. 5 shows that the sliding contact portion 31E of the first movable member 31C is in the rearmost detection hole 27B and the sliding contact portion 31E of the second movable member 31D is uncovered by the plate 32. At this time, the first movable member 31C and the second movable member 31D are in the off state, and the first movable members 31A, 31B are in the on state. With this combination, the image forming apparatus 1 recognize A5 size. At this time, the first sheet positioning member 19 is disposed in the position shown in FIG. 8B to position A5-sized sheets.

Although it is not shown, the sliding contact portion 31E of the first movable member 31B is in the third hole 27B from the rear, and the sliding contact portion 31E of the second movable member 31D is uncovered by the plate 32. At this time, the first movable member 31B and the second movable member 31D are in the off state, and the first movable members 31A, 31C are in the on state. With this combination, the image forming apparatus 1 recognize A6 size. At this time, the first sheet portioning member 19 is disposed in the position shown in FIG. 8C to position A6-sized sheets.

The second movable member 31D is pressed by the spring 35D. When the fourth boss 29J contacts the engagement portion 33A and the detection lever 33 pivotally moves, the spring 35D is elastically deformed and the second movable member 31D pivotally moves. When the fourth boss 29J is separated from the engagement portion 33A, the spring 35D returns to its original state and the second movable member 31D also pivotally moves to its original state.

Hereinafter, the state of each of the springs 35A to 35C of when the sliding contact portion 31E is inserted into the detection hole 27B and the state of the spring 35D of when the fourth boss 29J is engaged with the engagement portion 33A are referred to as initial state of the springs 35A to 35D.

The state of each of the springs 35A to 35C of when the sliding contact portion 31E is not inserted in the detection hole 27B and the state of the spring 35D of when the fourth boss 49J is separated from the engagement portion 33A are referred to as deformation state of the springs 35A to 35D.

The springs 35A to 35D according to the embodiment are plate springs whose portions contacting the movable members 31A to 31D protrude toward the movable members 31A to 31D.

The restriction mechanism 41 is configured to restrict the movement of the coupling member 29 as follows.

When the first sheet positioning member 19 is located in the most upstream position in the sheet supply direction, the coupling member 29 is disposed in the reference position relative to the first sheet positioning member 19. When the amount of movement of the first sheet positioning member 19 is smaller than or equal to the specified amount, the coupling member 29 is configured to move together with the first sheet positioning member 19 parallel thereto in the sheet supply direction while being maintained in the reference position.

In other words, as shown in FIGS. 8A and 8B, when the amount of movement of the first sheet positioning member 19 is smaller than or equal to the specified amount, the coupling member 29 is configured to move in the direction parallel to the sheet supply direction in a state in which its longitudinal direction agrees with the width direction.

When the amount of movement of the first sheet positioning member 19 exceeds the specified amount, as shown in FIG. 8C, the longitudinal direction of the coupling member 29 is inclined relative to the width direction such that a portion of the coupling member 29 closer to the first sheet positioning member 19 is disposed downstream from a portion of the coupling member 29 closer to the moving member 27 in the sheet supply direction.

As an example of a structure realizing the above restriction operation, the restriction mechanism 41 according to the embodiment includes the spring 29F, a protruding portion 41A and an engagement groove 41B. As shown in FIG. 5, the protruding portion 41A is disposed in a central portion of the coupling member 29 in its longitudinal direction.

The central portion of the coupling member 29 in the longitudinal direction is located at a position shifted from a joint coupling the first sheet positioning member 19 (or the coupling plate 29A) and the coupling member 29 toward the moving member 27. In the embodiment, as shown in FIG. 8A, a distance from the protruding portion 41A to the joint coupling the first sheet positioning member 19 and the coupling member 29 is greater in the width direction than a distance from the protruding portion 41A to a joint coupling the moving member 27 and the coupling member 29.

The bottom plate 17A has the engagement groove 41B extending in the sheet supply direction such that the protruding portion 41A is movable in the engagement groove 41B in the sheet supply direction. The engagement groove 41B according to the embodiment is a long hole passing through the bottom plate 17A in its thickness direction and extending in the sheet supply direction.

A length L1 of the engagement groove 41B is shorter than a length L2 of the guide portion 19A in the sheet supply direction. The lengths L1 and L2 are set such that, when the amount of movement of the first sheet positioning member 19 is equal to the specified amount, the protruding portion 41A is located at a downstream end of the engagement groove 41B in the sheet supply direction.

Thus, when the amount of movement of the first sheet positioning member 19 is smaller than or equal to the specified amount, the protruding portion 41A moves in the engagement groove 41B together with the first sheet positioning member 19 along the sheet supply direction. When the amount of movement of the first sheet positioning member 19 exceeds the specified amount, as shown in FIG. 8C, the protruding portion 41A is prevented from moving further in the sheet supply direction, and thus the coupling member 29 pivotally moves about, that is, pivots about the protruding portion 41A.

In other words, when the amount of movement of the first sheet positioning member 19 is smaller than or equal to the specified amount, the moving member 27 moves in response to the first sheet positioning member 19 in a same direction as that of the first sheet positioning member 19. When the amount of movement of the first sheet positioning member 19 exceeds the specified amount, the moving member 27 moves in response to the first sheet positioning member 19 in an opposite direction to that of the first sheet positioning member 19.

When the coupling member 29 pivots about the protruding portion 41A, the spring 29F gives the coupling member 29 a returning force to return the coupling member 29 to the reference position. The returning force is cancelled by engaging of the protrusions 19E into the holding portions 19D.

When the amount of movement of the first sheet positioning member 19 returns from a state in which it exceeds the specified amount to a state in which it is smaller than or equal to the specified amount, the coupling member 29 returns to the reference position by the returning force, that is, the elastic force of the spring 29F.

As shown in FIG. 8C, an area in which the moving member 27 moves is located within an area from a boundary line L3 toward the first sheet positioning member 19. In other words, the area in which the moving member 27 moves is located upstream from the boundary line L3 in the sheet supply direction. As shown in FIG. 8B, when the amount of movement of the first sheet positioning member 19 is equal to the specified amount, the moving member 27 approaches the boundary line L3 in a range in which the moving member 27 does not exceed the boundary line L3 in the sheet supply direction.

The boundary line L3 is an imaginary line passing an end portion of the grip portion 21A closer to the first sheet positioning member 19 and extending in the width direction.

As shown in FIGS. 3A and 3B, the output unit 25B according to the embodiment is configured to output an electrical signal by causing movable contacts 37A-37D to contact and separate from corresponding fixed contacts 39A-39D. The movable contacts 37A-37D and the fixed contacts 39A-39D are disposed at the main body and function as switches.

The movable contacts 37A-37D are disposed at the springs 35A-35D, respectively. That is, the springs 35A-35D are made of a conductive material, e.g., metal, and have the movable contacts 37A-37D at their free end portions. Fixed ends of the springs 35A-35D are fixed to the main body.

The spring 35A has the movable contact 37A. The spring 35B has the movable contact 37B. The spring 35C has the movable contact 37C. The spring 35D has the movable contact 37D.

With this structure, when the movable member 31A-31D pivotally moves, the corresponding spring 35A-35D responsively moves between the initial state and the deformation state. When the spring 35A-35D is placed in the initial state, the movable contact 37A-37D is separate from the fixed contact 39A-39D. When the spring 35A-35D is placed in the deformation state, the movable contact 37A-37D is in contact with the fixed contact 39A-39D.

The controller determines whether the amount of movement of the first sheet positioning member 19 is smaller than or equal to the specified amount by determining whether the movable contact 37D is in contact with the fixed contact 39D. The controller also specifies the position of the first sheet positioning member 19 by determining which one of the movable contacts 37A-37D is in contact with a corresponding one of the fixed contacts 39A-39D.

In the embodiment, when the amount of movement of the first sheet positioning member 19 is smaller than or equal to the specified amount, the moving member 27 moves together with the first sheet positioning member 19 parallel thereto in the same direction as shown in FIGS. 8A and 8B.

As shown in FIG. 8C, when the amount of movement of the first sheet positioning member 19 exceeds the specified amount, the coupling member 29 pivots about the protruding portion 41A and thus the moving member 27 moves in the opposite direction to that of the first sheet positioning member 19.

That is, in the embodiment, even if an area in which the first sheet positioning member 19 moves expands, an area in which the moving member 27 moves can be prevented from expanding on a proportional basis. Thus, even if the number of sizes of sheets of which the sheet supply tray 17 can receive increases, an area in which the moving member 27, such as a detection plate or a slider, moves can be prevented from expanding.

In the embodiment, the restriction mechanism 41 includes the spring 29F that prevents the coupling member 29 from pivotally moving relative to the first sheet positioning member 19.

With the restriction mechanism 41, the coupling member 29 can be prevented from pivotally moving when unnecessary. In addition, the position of the first sheet positioning member 19, that is, the size of a sheet received in the sheet supply tray 17, can be specified precisely.

In the embodiment, the area in which the moving member 27 moves is located upstream from the boundary line L3 in the sheet supply direction. When the user operates the second sheet positioning members 21, the moving member 27 is out of the way of the second sheet positioning members 21.

In the embodiment, the detection lever 33 is configured to move when the amount of movement of the first sheet positioning member 19 exceeds the specified amount, and the detection unit 31 is configured to determine the position of the first sheet positioning member 19 by detecting the detection hole 27B and the detection lever 33.

With this structure, detection can be easily made as to whether the direction in which the moving member 27 moves is reversed, that is, whether the amount of movement of the first sheet positioning member 19 exceeds the specified amount. In addition, the position of the first sheet positioning member 19 can be specified precisely.

In the embodiment, the moving member 27 is disposed on an opposite side of the bottom plate 17A to the moving mechanism 23 in a horizontal direction. With this arrangement, the moving member 27 will not interfere with the moving mechanism 23A and thus a degree of freedom in designing can be improved.

The above embodiment shows, but is not limited to, that the restriction mechanism 41 includes the protruding portion 41A disposed in the coupling member 29 and the engagement groove 41B formed in the bottom plate 17A.

For example, as a first option, the protruding portion 41A may be disposed at the bottom plate 17A and the engagement groove 41B may be formed at the coupling member 29. As a second option, the protruding portion 41A and the engagement groove 41B may be removed, and a stopper portion may be provided which contacts the central portion of the coupling member 29 in the longitudinal direction when the amount of movement of the first sheet positioning member 19 is equal to the specified amount. As a third option, the protruding portion 41A and the fourth boss 29J may be combined into one protruding portion.

In the case of the second option, when the amount of movement of the first sheet positioning member 19 is smaller than or equal to the specified amount, the central portion which contacts the stopper portion moves together with the first sheet positioning member 19 in the sheet supply direction, and when the amount of movement of the first sheet positioning member 19 exceeds the specified amount, the coupling member 29 pivots about the central portion.

The above embodiment shows, but is not limited to, that, when the coupling member 29 is in the reference position relative to the first sheet positioning member 19, the longitudinal direction of the coupling member 29 agrees with the width direction. For example, when the coupling member 29 is in the reference position relative to the first sheet positioning member 19, the longitudinal direction of the coupling member 29 may be inclined relative to the width direction.

The above embodiment shows, but is not limited to, that the fourth boss 29J and the protruding portion 41A are disposed in the same position on opposite sides of the coupling member 29 and thus an amount in which the coupling member 29 pivotally moves (hereinafter referred to as a first movement amount) is equal to an amount in which the detection lever 33 pivotally moves (hereinafter referred to as a second movement amount). The first movement amount and the second movement amount may be different from each other.

The above embodiment shows, but is not limited to, that the detection lever 33 is used to detect the direction in which the moving member 27 moves. Instead, the position of the first sheet positioning member 19 may be specified without detection of the direction of the moving member 27.

The above embodiment shows, but is not limited to, that the coupling member 29 is a strip. The coupling member 29 may be formed in any shape.

The above embodiment shows, but is not limited to, that the coupling member 29 is pivotally coupled at one end portion to the moving member and is pivotally coupled at the other end portion to the first sheet positioning member 19. The coupling member 29 may not pivotally move, and instead, for example, a rack and a pinion may be used such that, when the amount of the movement of the first sheet positioning member in the sheet supply direction exceeds the specified amount, the moving member 27 may move in the opposite direction to the sheet supply direction.

The above embodiment shows, but is not limited to, that the disclosure is applied to the electrophotographic type image forming apparatus 1. The disclosure may be applied to an inkjet type image forming apparatus.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit configured to form an image on a sheet;

a sheet supply tray having a bottom plate for supporting the sheet to be supplied to the image forming unit;

a first sheet positioning member configured to move relative to the bottom plate in a sheet supply direction, the first sheet positioning member being configured to position the sheet supported on the bottom plate by contacting an upstream end portion of the sheet in the sheet supply direction;

a moving member disposed at the sheet supply tray, the moving member being configured to move in the sheet supply direction in response to movement of the first sheet positioning member in the sheet supply direction, the moving member including a first detection portion;

a detection unit configured to detect the first detection portion of the moving member to determine a position of the first sheet positioning member;

a coupling member pivotally coupled at one end portion to the moving member and pivotally coupled at the other end portion to the first sheet positioning member, the coupling member being configured to move the moving member in response to the movement of the first sheet positioning member in the sheet supply direction; and a restriction mechanism configured to restrict movement of the coupling member, wherein the restriction mechanism is configured to restrict the movement of the coupling member such that, when an amount of the movement of the first sheet positioning member in the sheet supply direction is smaller than or equal to a specified amount, a central portion of the coupling member in a longitudinal direction thereof moves in the sheet supply direction together with the first sheet positioning member, wherein the restriction mechanism is configured to restrict the movement of the coupling member such that, when the amount of the movement of the first sheet positioning member in the sheet supply direction exceeds the specified amount, the central portion of the coupling member is prevented from moving further in the sheet supply direction together with the first sheet positioning member and the coupling member pivotally moves about the central portion thereof, and wherein the first detection portion of the moving member is configured to move in the sheet supply direction in which the first sheet positioning member moves.

2. The image forming apparatus according to claim 1, wherein the bottom plate includes a guide portion extending in the sheet supply direction and configured to guide the first sheet positioning member, wherein the restriction mechanism includes a protruding portion and an engagement groove, wherein the protruding portion is disposed in one of the coupling member and the bottom plate and protrudes toward the other one of the coupling member and the bottom plate, wherein the engagement groove is disposed in the other one of the coupling member and the bottom plate, extends in the sheet supply direction, and receives the protruding portion such that the protruding portion is movable in the engagement groove, and wherein a length of the engagement groove is smaller in the sheet supply direction than a length of the guide portion.

3. The image forming apparatus according to claim 2, wherein the restriction mechanism further includes a spring configured to apply an elastic force to the coupling member to prevent the coupling member from pivotally moving relative to the first sheet positioning member.

4. The image forming apparatus according to claim 3, wherein the first sheet positioning member includes a stopper portion configured to apply a force acting against the elastic force of the spring to the coupling member by contacting a portion of the coupling member.

5. The image forming apparatus according to claim 2, wherein the engagement groove is provided in the bottom plate; and wherein the protruding portion is disposed in the central portion of the coupling member and protrudes toward the bottom plate.

6. The image forming apparatus according to claim 1, further comprising:

a second sheet positioning member configured to move relative to the bottom plate in a width direction, which is a horizontal direction perpendicular to the sheet supply direction, the second sheet positioning member being configured to position the sheet supported on the bottom plate by contacting an end portion of the sheet in the width direction; and a grip portion disposed at the second sheet positing member, the grip portion being to be gripped by a user, wherein an area in which the moving member moves is located upstream from a boundary line in the sheet supply direction, the boundary line extending in the width direction and passing an end portion of the grip portion closer to the first sheet positioning member.

7. The image forming apparatus according to claim 1, further comprising a second detection portion configured to move when the amount of the movement of the first sheet positioning member exceeds the specified amount, wherein the detection unit is configured to determine the position of the first sheet positioning member by detecting the first detection portion and the second detection portion.

8. The image forming apparatus according to claim 1, further comprising:

a pressing plate disposed at the bottom plate and configured to move the sheet supported on the bottom plate upward; and a moving mechanism configured to move the pressing plate, wherein the moving member is disposed on an opposite side of the bottom plate to the moving mechanism in a horizontal direction.

9. The image forming apparatus according to claim 1, wherein a distance from the central portion of the coupling member to a joint coupling the first sheet positioning member and the coupling member is greater in the width direction than a distance from the central portion of the coupling member to a joint coupling the moving member and the coupling member.

10. The image forming apparatus according to claim 1, wherein, when the amount of the movement of the first sheet positioning member in the sheet supply direction is smaller than or equal to the specified amount, the moving member moves in a same direction as that of the first sheet positioning member, and wherein, when the amount of the movement of the first sheet positioning member in the sheet supply direction exceeds the specified amount, the moving member moves in an opposite direction to that of the first sheet positioning member.

11. The image forming apparatus according to claim 1, wherein the first sheet positioning member is configured to move in an opposite direction to the sheet supply direction.

12. The image forming apparatus according to claim 1, wherein the restriction mechanism is configured such that, when the amount of the movement of the first sheet positioning member in the sheet supply direction exceeds the specified amount, the coupling member pivotally moves about the central portion thereof to move the moving member in an opposite direction to the sheet supply direction.

13. The image forming apparatus according to claim 1, wherein, when the amount of the movement of the first sheet positioning member in the sheet supply direction is smaller than or equal to the specified amount, the moving member moves in a same direction as that of the first sheet positioning member, and wherein, when the amount of the movement of the first sheet positioning member in the sheet supply direction exceeds the specified amount, the moving member moves in an opposite direction to that of the first sheet positioning member.

14. An image forming apparatus comprising:

an image forming unit configured to form an image on a sheet;

a sheet supporting portion for supporting the sheet to be supplied to the image forming unit;

a first sheet positioning member configured to move relative to the sheet supporting portion in a sheet supply direction, the first sheet positioning member being configured to position the sheet supported on the sheet supporting portion by contacting an upstream end portion of the sheet in the sheet supply direction;

a moving member configured to move in the sheet supply direction in response to movement of the first sheet positioning member in the sheet supply direction, the moving member including a first detection portion;

a detection unit configured to detect the first detection portion of the moving member to determine a position of the first sheet positioning member;

a coupling member coupling the moving member and the first sheet positioning member, the coupling member being configured to move the moving member in response to the movement of the first sheet positioning member in the sheet supply direction; and a restriction mechanism configured to restrict movement of the coupling member, wherein the restriction mechanism is configured to restrict the movement of the coupling member such that, when an amount of the movement of the first sheet positioning member in the sheet supply direction is smaller than or equal to a specified amount, the moving member moves in the sheet supply direction, wherein the restriction mechanism is configured to restrict the movement of the coupling member such that, when the amount of the movement of the first sheet positioning member in the sheet supply direction exceeds the specified amount, the moving member is prevented from moving further in the sheet supply direction, wherein the coupling member includes a central portion in a longitudinal direction thereof, and wherein the restriction mechanism is configured such that, when the amount of the movement of the first sheet positioning member in the sheet supply direction exceeds the specified amount, the coupling member pivotally moves about the central portion thereof to move the moving member in an opposite direction to the sheet supply direction.

15. An image forming apparatus comprising:

an image forming unit configured to form an image on a sheet;

a sheet supporting portion for supporting the sheet to be supplied to the image forming unit;

a first sheet positioning member configured to move relative to the sheet supporting portion in a sheet supply direction, the first sheet positioning member being configured to position the sheet supported on the sheet supporting portion by contacting an upstream end portion of the sheet in the sheet supply direction;

a moving member configured to move in the sheet supply direction in response to movement of the first sheet positioning member in the sheet supply direction, the moving member including a first detection portion;

a detection unit configured to detect the first detection portion of the moving member to determine a position of the first sheet positioning member;

a coupling member coupling the moving member and the first sheet positioning member, the coupling member being configured to move the moving member in response to the movement of the first sheet positioning member in the sheet supply direction; and a restriction mechanism configured to restrict movement of the coupling member, wherein the restriction mechanism is configured to restrict the movement of the coupling member such that, when an amount of the movement of the first sheet positioning member in the sheet supply direction is smaller than or equal to a specified amount, the moving member moves in the sheet supply direction, wherein the restriction mechanism is configured to restrict the movement of the coupling member such that, when the amount of the movement of the first sheet positioning member in the sheet supply direction exceeds the specified amount, the moving member is prevented from moving further in the sheet supply direction, wherein, when the amount of the movement of the first sheet positioning member in the sheet supply direction is smaller than or equal to the specified amount, the moving member moves in a same direction as that of the first sheet positioning member, and wherein, when the amount of the movement of the first sheet positioning member in the sheet supply direction exceeds the specified amount, the moving member moves in an opposite direction to that of the first sheet positioning member.

16. The image forming apparatus according to claim 15, wherein the coupling member includes a central portion in a longitudinal direction thereof, and wherein the restriction mechanism is configured such that, when the amount of the movement of the first sheet positioning member in the sheet supply direction exceeds the specified amount, the coupling member pivotally moves about the central portion thereof to move the moving member in an opposite direction to the sheet supply direction.

17. The image forming apparatus according to claim 15, wherein the first sheet positioning member is configured to move in an opposite direction to the sheet supply direction.

18. The image forming apparatus according to claim 15, wherein the first detection portion of the moving member is configured to move in the sheet supply direction in which the first sheet positioning member moves.

* * * * *